United States Patent [19]

Hundebol

[11] Patent Number: 4,967,513

[45] Date of Patent: Nov. 6, 1990

[54] BELT SANDING MACHINE

[75] Inventor: Keld O. Hundebol, Ansager, Denmark

[73] Assignee: HH Patent ApS, Ansager, Denmark

[21] Appl. No.: 299,943

[22] PCT Filed: May 25, 1988

[86] PCT No.: PCT/DK88/00083

§ 371 Date: Jan. 11, 1989

§ 102(e) Date: Jan. 11, 1989

[87] PCT Pub. No.: WO88/09241

PCT Pub. Date: Dec. 1, 1988

[30] Foreign Application Priority Data

May 27, 1987 [DK] Denmark ..... 2739/87

[51] Int. Cl.[5] ..... B24B 21/12

[52] U.S. Cl. ..... 51/135 R; 51/141; 51/170 EB

[58] Field of Search ..... 51/135 R, 141 R, 137, 51/138, 139, 147, 102, 108, 170 EB

[56] References Cited

U.S. PATENT DOCUMENTS 1,841,411 1/1932 Kux .
2,192,240 3/1940 Richardson ..... 51/145
3,496,679 2/1970 Dunn ..... 51/135 R
3,516,207 6/1970 Baden ..... 51/135

FOREIGN PATENT DOCUMENTS 1148465 11/1963 Denmark .

*Primary Examiner*—Frederick R. Schmidt
*Assistant Examiner*—Mark F. Frazier
*Attorney, Agent, or Firm*—Kenyon & Kenyon

[57] ABSTRACT

When sanding for instance panelled doors in a belt sanding machine it must be prevented that transversely extending parts (16) are sanded since it would be harmful to sand across the direction of the grain of the wood. A machine according to the invention is therefore provided with a combined sensing and control device which in a simple and effective manner will prevent damage caused by the sanding process by controlling the contact of the sanding belt with the workpiece. The device consists of a disc (14, 20) which is mounted on the sanding equipment. The disc (14, 20) protrudes a distance beyond the sanding position of the sanding belt (15), in order that the disc will sense the workpiece when the workpiece is moved under the sanding belt. When the disc (14, 20) rolls across a frame piece (16) the sanding belt (15) is pivoted up above the wood, and when the disc (14, 20) meets a recessed part (18), the sanding belt (15) is pivoted to a non-sanding position.

9 Claims, 2 Drawing Sheets

BELT SANDING MACHINE

Figure 2:
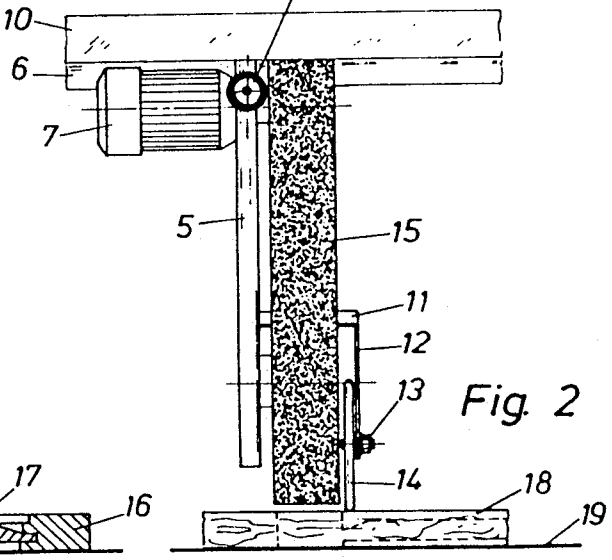

The invention relates to a belt sanding machine especially for sanding wooden workpieces consisting of frame pieces around panelling, said panelling being recessed in relation to the frame pieces, and where the workpieces are carried forward on a conveyor belt below the belt sanding machine's lower turning roller for the sanding belt.

Machines of this type are particularly used within the furniture industry for sanding and polishing panelled doors and similar objects which are built of wooden frame pieces, with the grains of meeting frame pieces extending in different directions.

In order to avoid causing damage to the wood, it has to be sanded with the grains, and this means that a workpiece must be sanded in at least two different directions in order for the frame pieces to be sanded along the grain. Add to this that the sanding must be commenced and finished in the centre part of the workpiece in order to avoid damage to the frame pieces that extend transversely along the outer side.

Hitherto known machines for this purpose are extremely complicated and difficult to use, because they require a uniform product and a correspondingly precise conveyance below the sanding belt for each setting. Moreover, such machines are very expensive.

The machines are based on a sanding principle that comprises one or more thrust pads extending behind the sanding belt, which thrust pads can be actuated for pressing down the sanding belt towards the workpiece on a signal from an impulse transmitter. Similarly, the pressure against the sanding belt may be discontinued and the sanding stopped when the pressure of the thrust pad against the sanding belt is discontinued. An example of such a construction is described in German published specification No. 1,148,465.

This known construction thus comprises a separate sensing device which senses the item during its travelling below the sanding belt, and which produces a signal to a thrust pad which adjusts the position of the sanding belt in relation to the surface of the item. This is a complicated and poor solution, in that it cannot be avoided that considerable friction between the thrust pad and the sanding belt occurs when the sanding belt is pressed against the item. Add to this the complex construction of the sensory and adjustment equipment, and the use of signals which must be converted into adjustment signals for the pressure device.

It is the object of the invention to overcome these drawbacks of the known machines, and this is achieved by a machine wherein a lower sanding belt drum is provided with a mechanical sensing device follower which senses the the recessed panel while the drum is sanding along the grain of a frame piece and causes the sanding drum to be lifted up once the sensing device contacts an adjacent frame piece and is moved up from the recessed panel.

By an extremely simple and reliable method a sanding belt is hereby achieved where a lower drum of a belt sander is capable of adjusting itself to the shape of the workpiece merely by means of a sensing device which exerts a direct influence on the position of the drum in relation to the workpiece. Progamming, remote monitoring, thrust pads and connection means are hereby eliminated.

By designing the sensing device as a disc which can roll across the workpiece when the workpieces is conveyed below the sanding belt and which by its contact to the workpiece determines the position of the sanding belt, there is obtained a completely reliable and precise adjustment of the sanding process.

By mounting the disc directly on the axle of the lower turning roller, there is obtained a simple and strong construction.

By attaching the disc to an arm the sensing may be displaced in relation to the contact region of the sanding belt, and it becomes possible to sand items where the recess is displaced in relation to the required sanding point.

Finally it is expedient to be able to adjust the position of the disc in relation to the sanding belt in that it thereby becomes possible to adapt the machine to any required workpiece.

Figure 1:
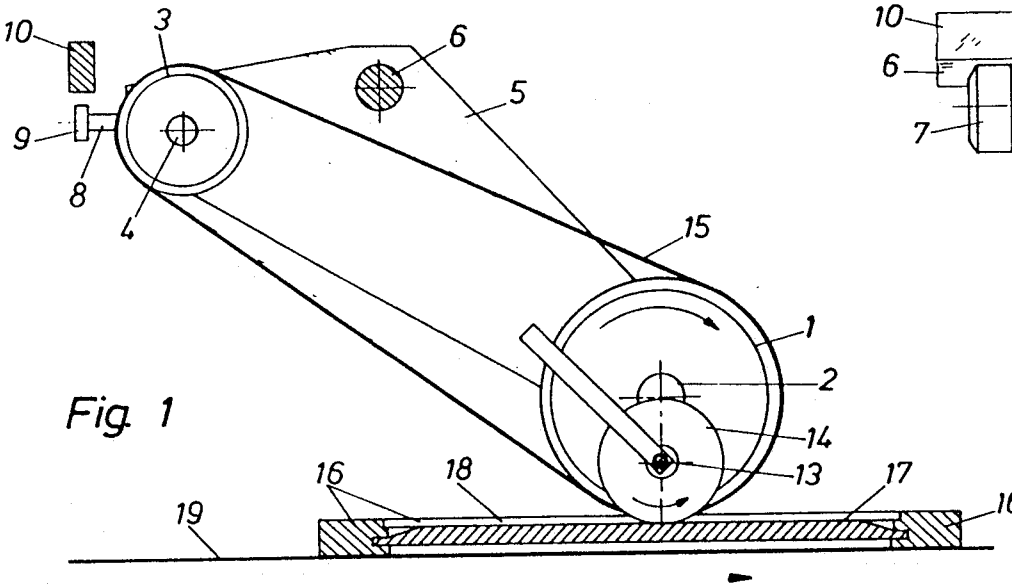
Figure 3:
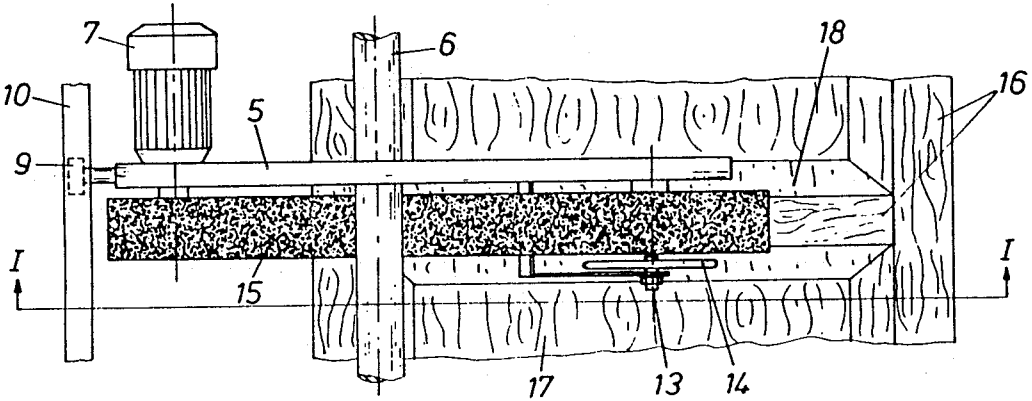

In the following the invention will be described in closer detail with reference to the drawing, wherein FIG. 1 is a cross section of a sanding machine in the direction I—I in FIG. 3, FIG. 2 shows the machine seen from the feed end of the workpiece, FIG. 3 is a top view of the machine.

Figure 4:
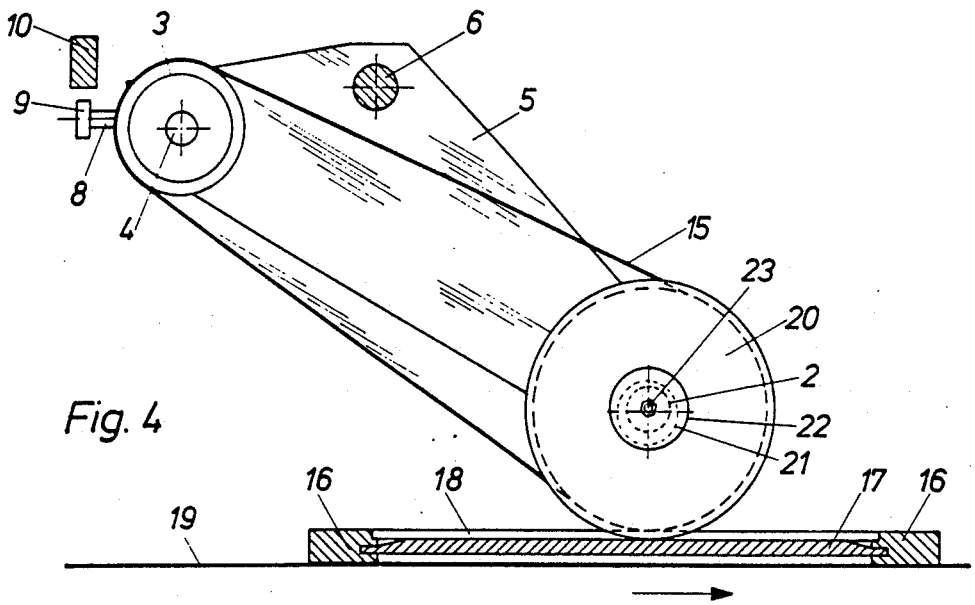
Figure 5:
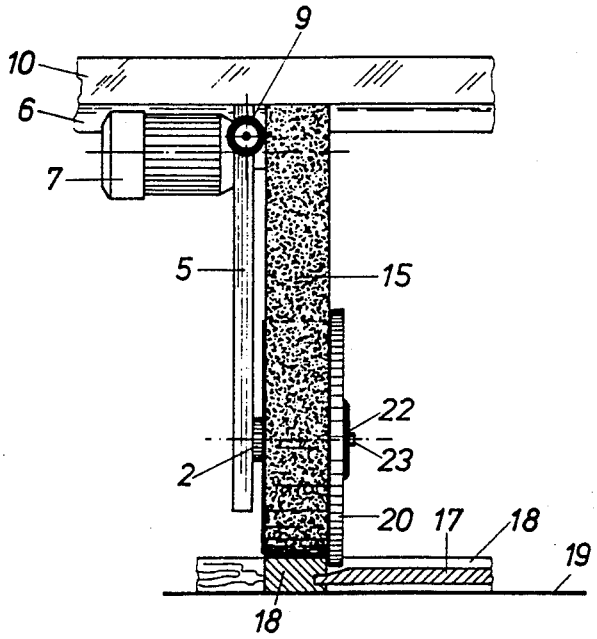

FIG. 4 is a cross section of a second embodiment of the sanding machine, and FIG. 5 shows this embodiment seen from the feed end of the workpiece.

In the drawing there is shown an example of two embodiments of a belt sanding machine according to the invention, and in schematic form, in that the frame of the machine is not shown, whereas merely those components as take part in the actual sanding and adjusting operation of the machine are shown.

The actual sanding unit comprises a plate part 5 which is pivotably mounted to an axle 6 extending across the machine. On this part 5 a drive motor 7 is provided which over a shaft 4 drives an upper belt drum 3.

At the lower end of the plate a lower belt drum 1 is mounted, said drum rotating on an axle 2.

An endless sanding belt 15 runs on these two belt drums 1, 3.

At the top of the plate 5 there is moreover mounted a horizontally extending pin 8 on which a bearing 9 is arranged. Moreover, a sliding part 10 is mounted on the frame of the machine above this bearing 9, said sliding part being vertically adjustable.

When the plate 5 is pivoted around the axle 6 the lower belt drum 1 is lifted and lowered in relation to the underlying conveyor belt 19 extending endlessly in the direction of the arrow.

The sliding part 10 forms a stop for the position of the sanding belt in relation to the conveyor belt 19 so that it is possible to adjust the sanding depth by adjusting the vertical position of the sliding part 10.

A disc or roll 14 is mounted on the plate 5, as shown in FIGS. 1-3, said disc being loosely mounted on a spindle 13 fitted to an arm 12 which in turn is attached to the plate 5 by a bracket 11. The disc 14 protrudes a distance down below the sanding belt 15 and may furthermore be adjusted in relation to the belt drum 1 and the sanding belt 15, both in relation to the workpiece and in relation to the point of contact between the sanding belt and the workpiece. This may take place by extending the arm 12 and/or by changing its angle in relation to the plate 5.

In a second embodiment shown in FIGS. 4 and 5 the disc 20 is mounted directly or an extension of the axle 2 of the belt drum 1, which simplifies the construction considerably. This embodiment may of course only function if the disc 20 has a diameter which is larger than the total diameter of the lower belt drum 1 and the sanding belt 15 in order to ensure that the sanding head may be lifted free from the workpiece by pivoting around the axle 6.

Furthermore, the disc 20 can be mounted on an eccentric ring 21, shown by a dotted line in FIG. 4, which can be attached to the end of the axle 2 by means of a disc 22 and a clamping bolt 23 screwed into the end of the axle 2. By slackening the bolt 23, the eccentric ring 21 can be turned in relation to the axle whereby the position of the disc 20 in relation to the sanding belt 15 can be adjusted. This is expedient, especially in connection with workpieces with a small difference of level between those areas that must be sanded and those that should be sensed by the disc 20.

The mode of operation of the device will now be described in closer detail.

The workpiece, as shown in the drawing, is a panelled door, which is built of wooden frame pieces 16 surrounding a panel 17 so that there is a difference in level between the frame and the panelling.

The panel 17 is moreover chamfered at the frame 16 in order that a groove 18 is formed along the frame 16.

When the workpiece is inserted on the conveyor belt 19' the frame 16 which is to be sanded is placed opposite the sanding belt. The conveyor belt conveys the workpiece, and the disc 14, 20 will at the beginning of the movement roll on the frontmost transverse wooden frame piece thereby lifting the sanding belt and preventing sanding across the wooden frame piece, as shown in FIG. 2, thus avoiding damage to this piece. When the workpiece is further conveyed, the disc 14, 20 will slide down in the groove 18, as shown in FIGS. 1, 3, 4 and 5, and the sanding belt will be lowered to make sanding contact with the longitudinal frame part 16 in the direction of the grain.

When sanding of this frame part 16 is finished, the disc 14, 20 will then roll across the rearmost longitudinal frame part 16 and thereby lift up the belt drum 1 and the sanding belt 15 to an inactive position.

In this manner it will be possible to sand the inner frame pieces with the grain without touching the parts extending across the sanding direction, merely by adjusting the disc 14, 20 in relation to the recessed panel.

By adjusting the sliding part 10, it becomes possible to adjust the sanding depth and thereby ensure that the workpiece obtains the required thickness.

I claim:

1. A belt sanding machine for sanding wooden workpieces which are conveyed on a conveyor belt, the machine comprising:

first and second turning rollers mounted for rotation on spaced apart first and second axles, respectively, the first turning roller being urged into contact with a workpiece on the conveyor belt, and an endless sanding belt extending around the turning rollers, said first turning roller having an annular sensing disk mounted on the first axle, said disk having a circular outer peripheral edge with a diameter larger than the diameter of the first turning roller taken in combination with the sanding belt, and wherein the position of the center of the disk is adjustable relative to the axis of rotation of the first turning roller by means of an eccentric ring releasably secured to the axle.

2. The belt sanding machine of claim 1 wherein the eccentric ring is nested within an eccentric hole in the disk, so that the disk is mounted on the eccentric ring which is mounted onto the first axle.

3. The belt sanding machine of claim 2 wherein the angular orientation of the disk about the first axle is fixed by the use of a smaller locking disk overlying both the eccentric ring and a portion of the sensing disk, the locking disk being pressed into frictional engagement with the eccentric ring and the sensing disk by means of a clamping bolt secured into an end of the first axle.

4. A sanding machine for sanding wooden workpieces which are conveyed on a work support device that moves in a predetermined direction, the sanding machine comprising:

a sanding drum;

means for mounting the sanding drum for rotation about a first axis extending transversely to the direction of movement of the work support device, the mounting means permitting the sanding drum to move toward and away from the work support surface so as to bring a peripheral sanding surface on the sanding drum into contact with a workpiece being conveyed on the moving work support device;

an annular bushing having a circular inner surface and a circular outer surface that is eccentric with respect to the inner surface;

means for mounting the bushing with the inner surface concentric with the first axis;

an annular sensing disk having a circular inner mounting surface and an outer peripheral sensing surface;

means for mounting the sensing disk with its inner mounting surface concentric with the outer surface of the bushing; and means for releasably locking the bushing at any angular orientation relative to the first axis and for releasably locking the sensing disk at any angular orientation relative to the bushing so as to selectively adjust distances and angular orientations of points on the outer peripheral surface of the sensing disk relative to the first axis.

5. A sanding machine according to claim 4 wherein the outer peripheral sensing surface to the sensing disk is a circular surface.

6. A sanding machine according to claim 5 wherein the outer peripheral sensing surface of the sensing disk is eccentric to the inner mounting surface of the disk.

7. A sanding machine according to claim 5 wherein the diameter of the outer sensing surface of the sensing disk is greater than the diameter of the sanding surface on the sanding drum.

8. A sanding machine for sanding wooden workpieces which are conveyed on a work support device that moves in a predetermined direction, the sanding machine comprising:

a sanding drum;

an axle mounting the sanding drum for rotation about a first axis extending transversely to the direction of movement of the work support device, the mounting means permitting the sanding drum to move toward and away from the work support surface so as to bring a peripheral sanding surface on the sanding drum into contact with a workpiece being conveyed on the moving work support device;

a sensing disk having an outer circular peripheral sensing surface defining a predetermined path around a second axis extending perpendicular to the disk, said second axis further being concentric with the sensing surface;

an axle mounting the sensing disk, said axle being collinear with said second axis and lying adjacent the sanding drum;

a mounting hole on the sensing disk located eccentrically to the second axis; and means for mounting the sensing disk on the axle adjacent to the sanding drum with the second axis parallel to the first axis, said mounting means comprising an eccentric annular bushing disposed in the mounting hole of the sensing disk, the bushing having an inner circumferential circular surface concentric with the first axis and an outer peripheral circular surface eccentric to the inner circumferential circular surface, whereby said mounting means permits the selective adjustment of distance and angular orientation of the second axis relative to the first axis.

9. A sanding machine according to claim 8 wherein the eccentricity of the outer and inner surfaces of the bushing is equal to the eccentricity of the mounting hole of the sensing disk.

* * * * *